US009697665B2

(12) United States Patent
Hayashi et al.

(10) Patent No.: US 9,697,665 B2
(45) Date of Patent: Jul. 4, 2017

(54) COIN DISPENSING DEVICE

(71) Applicant: NIPPON CONLUX CO., LTD., Sakado-shi (JP)

(72) Inventors: Takahiro Hayashi, Sakado (JP); Masashi Kondo, Sakado (JP)

(73) Assignee: NIPPON CONLUX CO., LTD., Sakado-shi (JP)

( * ) Notice: Subject to any disclaimer, the term of this patent is extended or adjusted under 35 U.S.C. 154(b) by 1 day.

(21) Appl. No.: 15/035,139

(22) PCT Filed: Dec. 12, 2013

(86) PCT No.: PCT/JP2013/083328

§ 371 (c)(1),
(2) Date: May 6, 2016

(87) PCT Pub. No.: WO2015/068314

PCT Pub. Date: May 14, 2015

(65) Prior Publication Data

US 2016/0275742 A1 Sep. 22, 2016

(30) Foreign Application Priority Data

Nov. 6, 2013 (JP) ..... 2013-229921

(51) Int. Cl.
*G07D 1/00* (2006.01)
*G07D 1/02* (2006.01)
*G07F 5/24* (2006.01)

(52) U.S. Cl.
CPC ..... *G07D 1/02* (2013.01); *G07D 1/00* (2013.01); *G07F 5/24* (2013.01); *G07D 2201/00* (2013.01)

(58) Field of Classification Search
CPC .. G07D 1/00; G07D 1/02; G07D 1/04; G07D 1/06; G07D 1/08; G07D 2201/00;
(Continued)

(56) References Cited

U.S. PATENT DOCUMENTS 4,374,529 A * 2/1983 Kobayashi ..... G07D 1/00 221/11
5,697,483 A 12/1997 Ishida et al.
(Continued)

FOREIGN PATENT DOCUMENTS

JP 7-262426 A 10/1995
JP 11-161825 A 6/1999
(Continued)

OTHER PUBLICATIONS

International Search Report issued Mar. 18, 2014 in PCT/JP2013/083328 Filed Dec. 12, 2013.

*Primary Examiner* — Jeffrey Shapiro
(74) *Attorney, Agent, or Firm* — Oblon, McClelland, Maier & Neustadt, L.L.P.

(57) ABSTRACT

A coin dispensing device includes a plurality of coin tubes storing coins, a coin withdrawing and discharging part, a change part which locates a change lever at a dispensing preventing position, in which the coin withdrawing and discharging part is prevented from discharging coins, by energizing a change lever solenoid and locates the change lever at a dispensing allowing position, in which the coin withdrawing and discharging part is allowed to discharge the coins, by a biasing force of a return spring when the energizing of the change lever solenoid is stopped, and a keeping means which keeps a state of the change lever. The coin withdrawing and discharging part withdraws and discharges the coins when the keeping means keeps the state of the change lever and the energizing of the change lever solenoid is stopped.

3 Claims, 9 Drawing Sheets

(58) Field of Classification Search
CPC ..... G07D 9/002; G07D 9/004; G07D 9/006; G07D 9/008; G07D 9/065; G07D 9/06; G07D 13/00; G07F 5/24; G07F 19/203; G07F 3/04; G07F 5/20; G07F 11/16; G07F 11/24; G07F 11/40; G07F 11/20; G07F 11/02; G07F 11/22; G07F 5/26; G07F 9/06; G07F 13/00; G07F 13/02; G07F 13/025; G07F 15/00; G07F 15/001
USPC ..... 453/37–48, 53, 54, 61, 62, 18–28
See application file for complete search history.

(56) References Cited

U.S. PATENT DOCUMENTS

| | | | | |
|---|---|---|---|---|
| 6,176,773 | B1 * | 1/2001 | Mikami | G07F 5/24 453/21 |
| 6,565,427 | B2 * | 5/2003 | Kuwabara | G07D 1/00 453/21 |
| 6,896,114 | B1 * | 5/2005 | Matsumoto | G07F 5/24 194/202 |
| 2005/0124280 | A1 * | 6/2005 | Itako | G07D 1/02 453/18 |

FOREIGN PATENT DOCUMENTS

| | | | |
|---|---|---|---|
| JP | 11-259735 | A | 9/1999 |
| JP | 3054908 | B2 | 6/2000 |
| JP | 2004-62420 | A | 2/2004 |

* cited by examiner

[Fig.1]
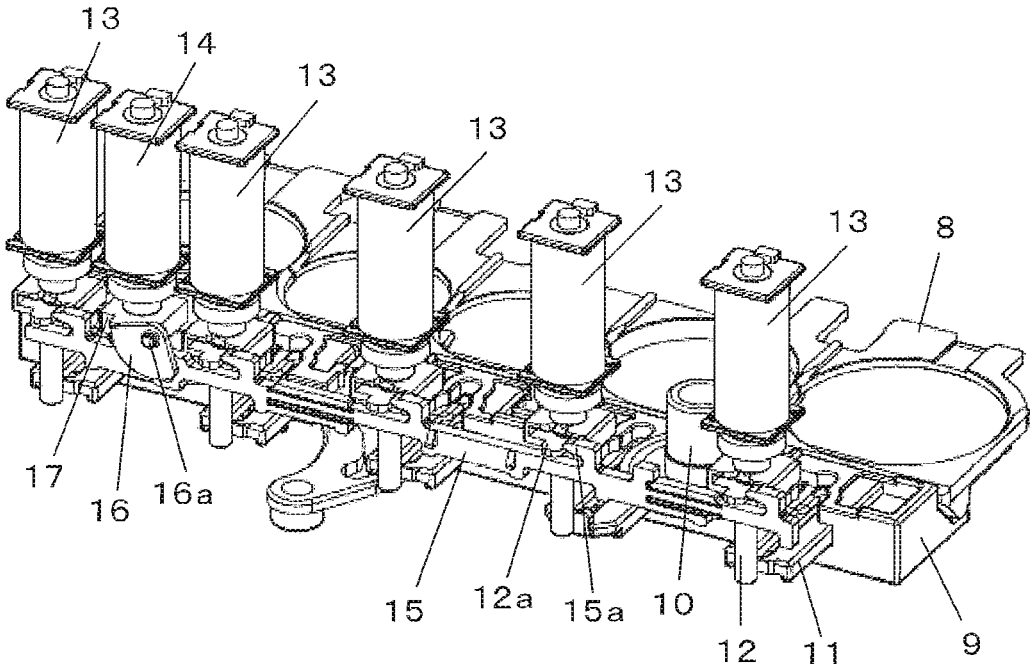

[Fig.2]
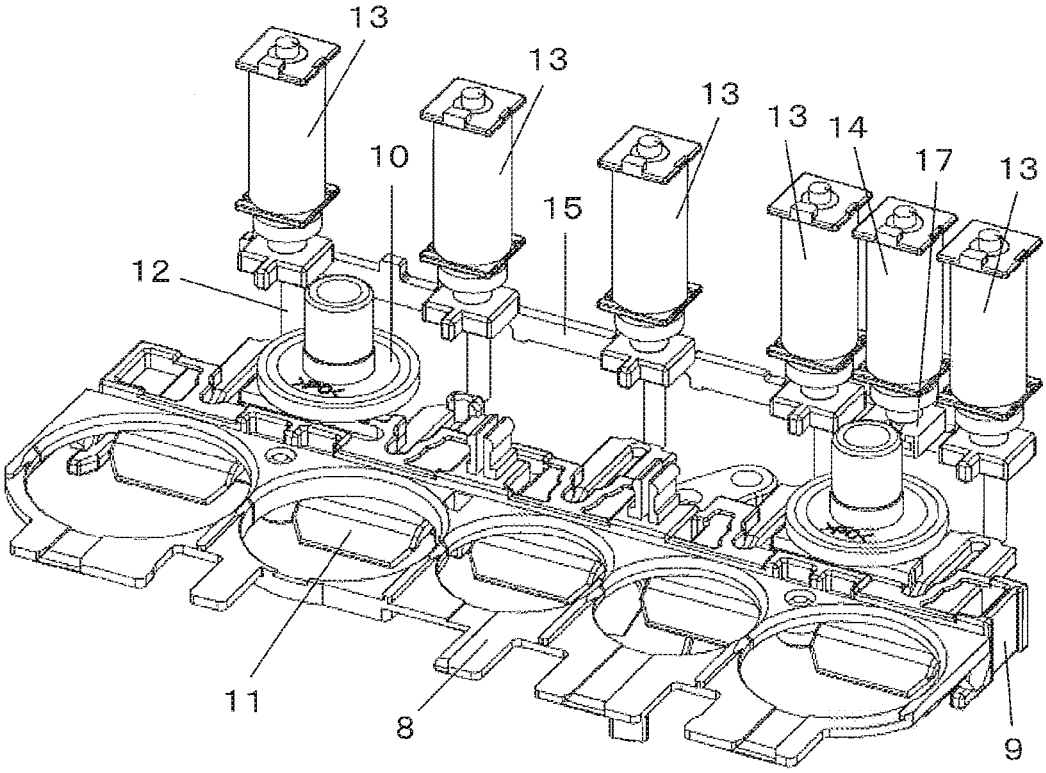

[Fig.3]
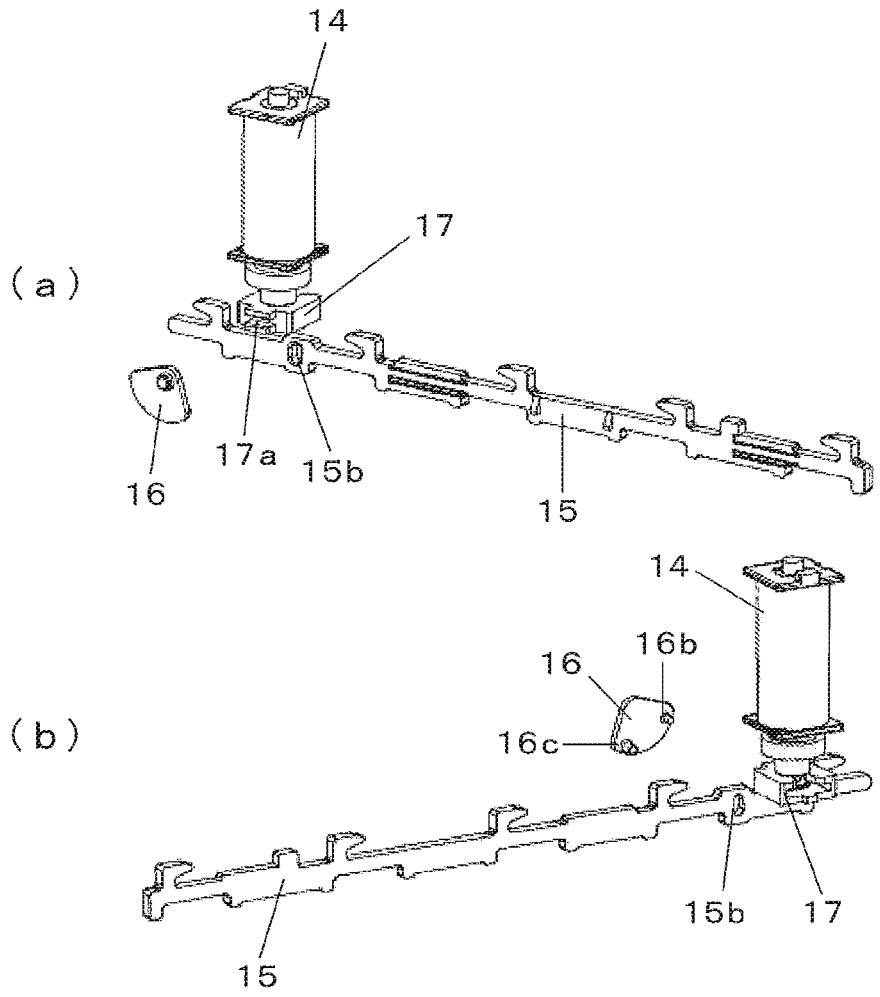

[Fig.4]
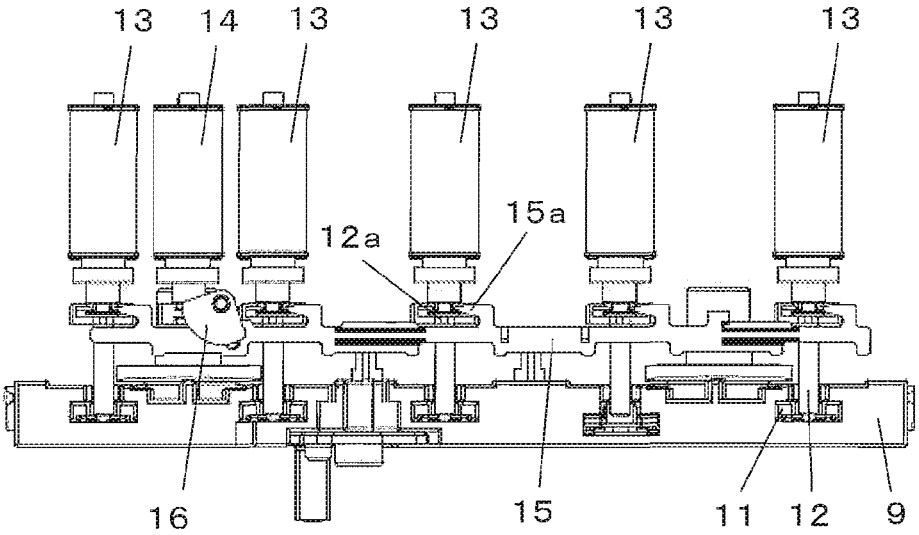
[Fig.5]
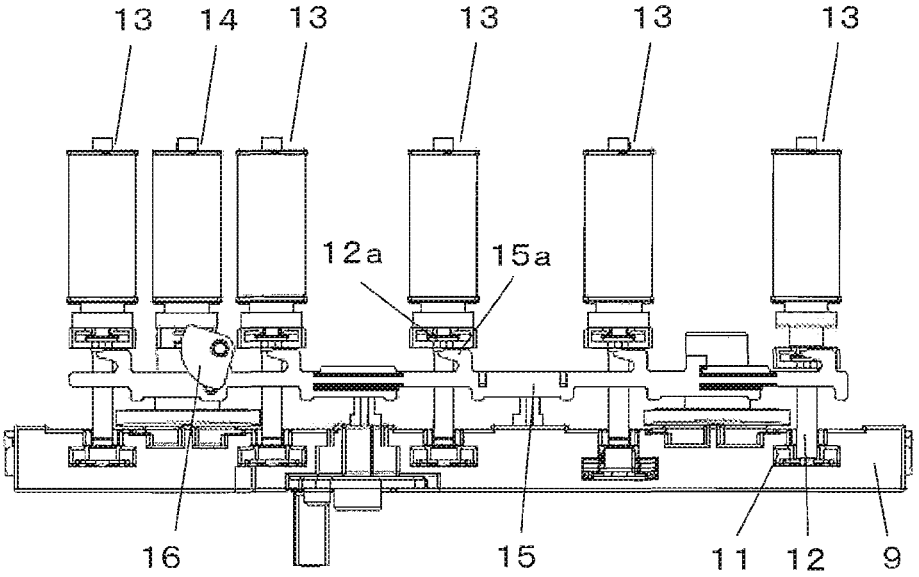

[Fig.6]
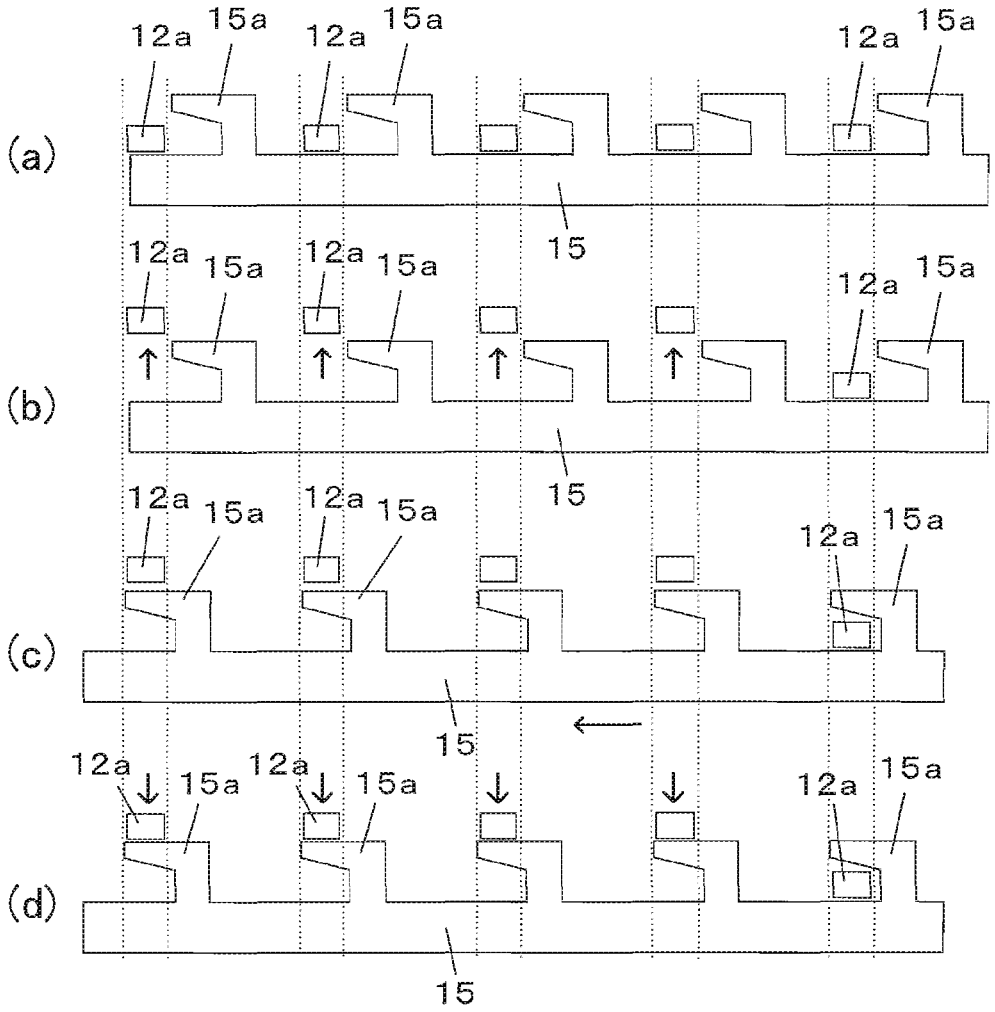

[Fig.7]
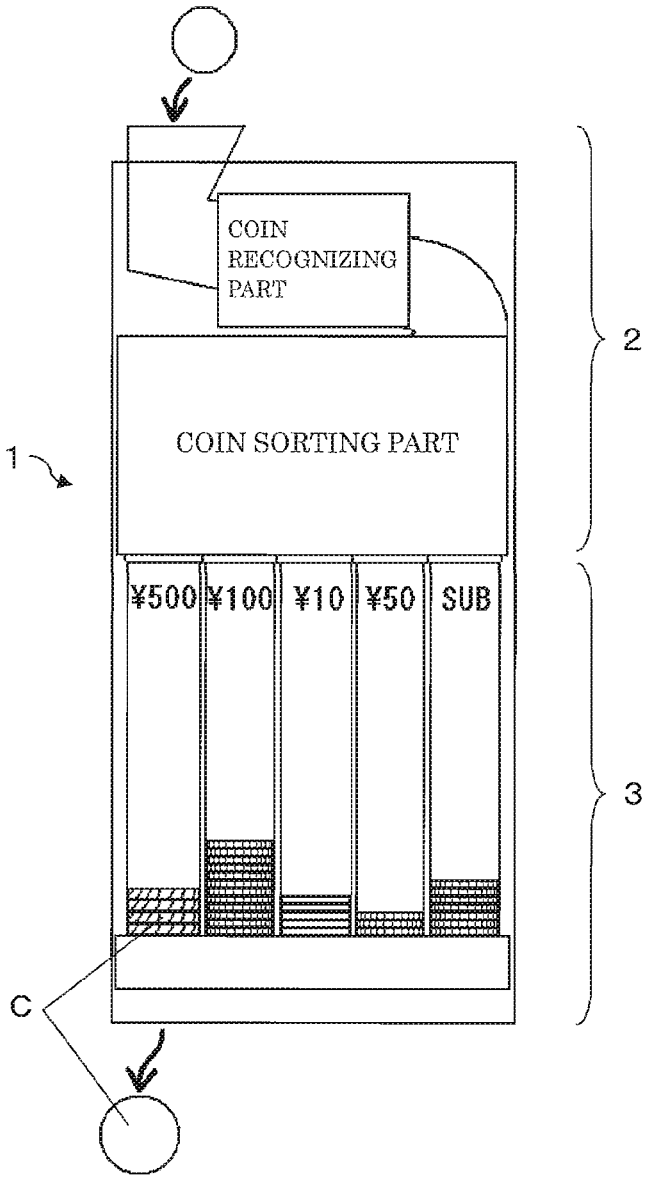

[Fig.8]
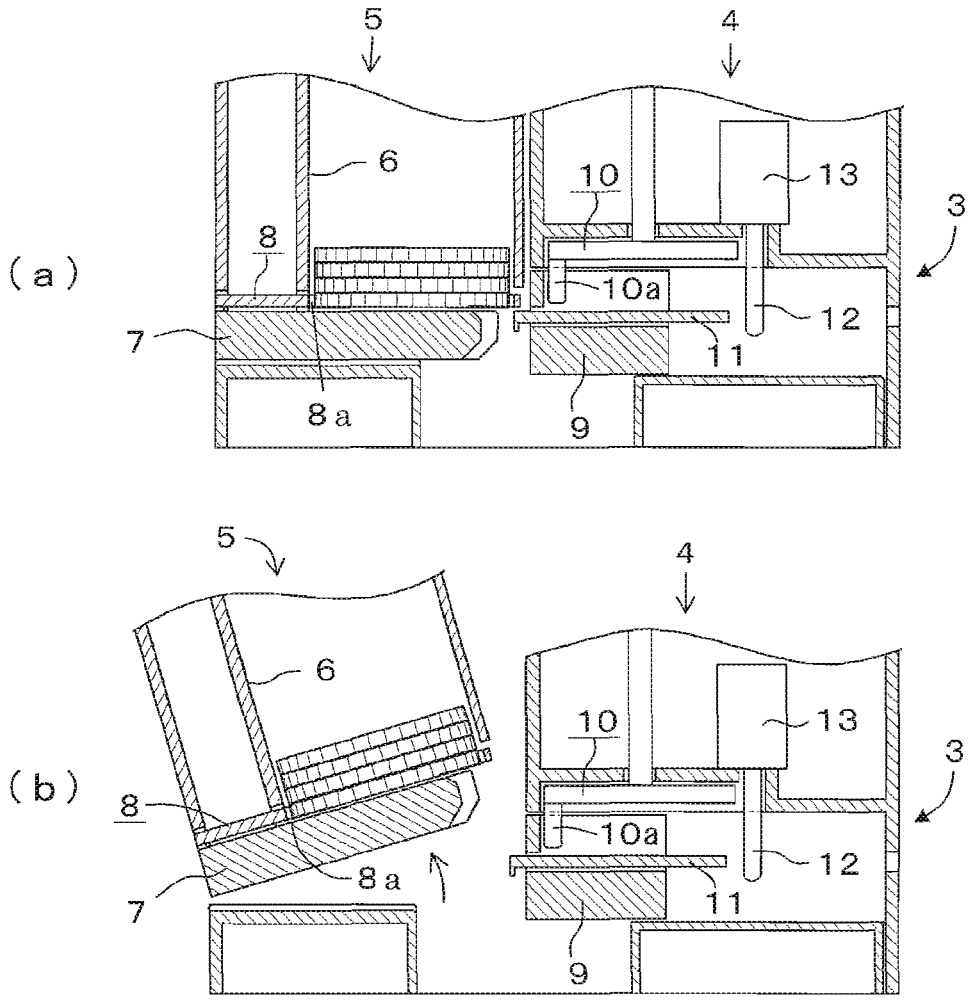

[Fig.9]
(a)
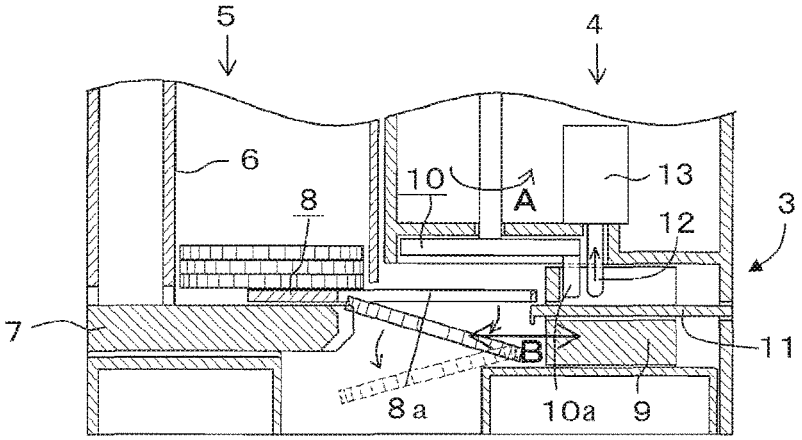
(b)
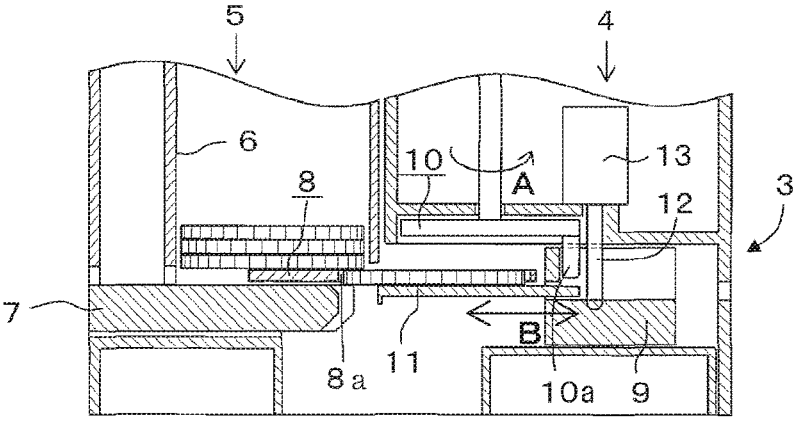

[Fig.10]
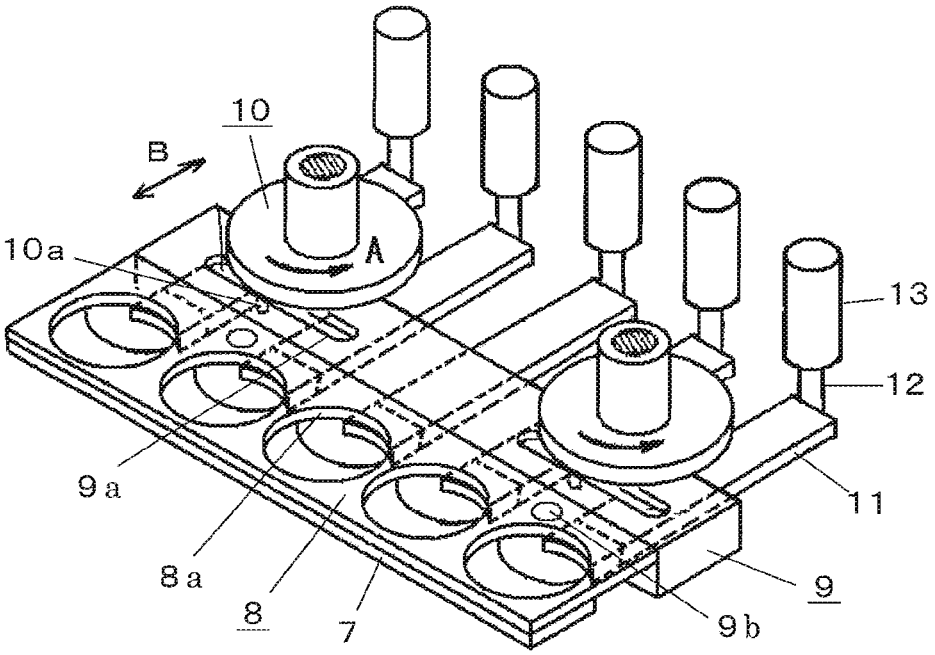

COIN DISPENSING DEVICE

TECHNICAL FIELD

The present invention relates to a coin processing device mounted on vending machines, money exchanging machines, check out machines, ticket-vending machines or service equipment, etc. (hereinafter referred to as "vending machine"), in particular, relates to a coin dispensing device which forms a part of such a coin processing device and dispenses coins sorted and stored by denomination in accordance with an amount of change.

BACKGROUND ART

Conventionally, a coin processing device which recognizes the authenticity of a charged coin, sorts and stores a coin considered as a normal coin by denomination, and dispenses the sorted and stored coin in accordance with an amount of change is mounted inside the vending machine. FIG. 7 illustrates a schematic view of such a coin processing device.

The coin processing device 1 is mainly provided with a coin sorting device 2 which recognizes the authenticity of charged coins and sorts the charged coins by denomination, and a coin dispensing device 3 which stores the charged coins sorted by the coin sorting device 2 by denomination and dispenses the coin by selecting coin to be dispensed in accordance with an amount of change. Further, the coin sorting device 2 has a coin recognizing part which recognizes the authenticity of the charged coins, and a coin sorting part which sorts the coins considered as normal coins by the coin recognizing part by denomination. Further, the coin dispensing device 3 has a coin storing part provided with a plurality of coin tubes, each of which stores the coins sorted by the coin sorting device 2 by each denomination, and a coin dispensing mechanism which dispenses the coin from the coin storing part by selecting coin in accordance with an amount of change. As the coin dispensing mechanism, a configuration which dispenses the coins stored in the coin tube by withdrawing the coins from a slit-like hole formed at the lowest part of the coin tube by a slide member called as a payout slide is widely adopted. Further, in the coin dispensing device 3, in order to facilitate withdrawing of the coins when the coins stored in the coin dispensing device 3 are collected as sales, the coin storing part is normally formed as a detachable cassette.

In Patent Literature (JP H07-262426 A), Patent Literature 2 (JP H11-161825 A) and Patent Literature 3 (JP 3054908 B), coin dispensing devices mounted on the conventional coin processing devices are disclosed.

Hereinafter, a configuration of the conventional coin dispensing device is described with reference to FIGS. 8(*a*), 8(*b*), 9(*a*), 9(*b*) and 10.

FIGS. 8(*a*), 8(*b*), 9(*a*) and 9(*b*) illustrate cross-sectional views of a main part of the conventional coin dispensing device, and FIG. 10 illustrates a schematic perspective view of the conventional coin dispensing device in which an illustration of the coin tube, a wall of the device and the like is omitted. FIG. 8(*a*) illustrates a cross-sectional view of a main part of the coin dispensing device in a state before the coins are dispensed (hereinafter referred to as "standby state"), FIG. 8(*b*) illustrates a cross-sectional view of the main part of the coin dispensing device in a state after the cassette of the coin storing part is removed, and FIGS. 9(*a*) and 9(*b*) illustrate cross-sectional views of the main part of the coin dispensing device in a dispensing operation of the coins (hereinafter referred to as "dispensing state"). Further, FIG. 10 illustrates a schematic perspective view of the coin dispensing device in the standby state.

The conventional coin dispensing device 3 illustrated in FIGS. 8(*a*), 8(*b*), 9(*a*), 9(*b*) and 10 has a driving means such as a motor not shown in Figs, a payout cam 10 turned once in one direction (direction of an arrow A) per one dispensing operation by means of a driving force of the driving means, a payout link 9 having a groove 9*a* engaged with a pin 10*a* protruded from a lower surface of the payout cam 10, the payout link 9 being reciprocated in a direction of an arrow B from an original position shown in Figs when the payout cam 10 is turned once, and a payout slide 8 which detachably engages with the payout link 9 via a pin 9*b* (see FIG. 10) and reciprocates in the direction of the arrow B by interlocking with a reciprocating movement of the payout link 9. Here, the payout link 9 and the payout slide 8 are detachable from each other because the payout slide 8 is mounted together with the coin storing part on a cassette 5 detachable from a device body 4.

Further, a plurality of coin storing holes 8*a*, each of which corresponds to each coin tube 6 of the coin storing part and stores only one coin stored at each lowest surface of coin tubes 6, is formed on the payout slide 8. Further, a bottom plate 7 of the cassette 5 is disposed below the coin storing hole 8*a*, and in the standby state shown in FIG. 7, the bottom plate 7 supports the coin stored in the coin storing hole 8*a*.

On the other hand, a plurality of change slides 11, each of which has a tip part to be arranged below each coin storing hole 8*a* of the payout slide 8 and switches a dispensing and a non-dispensing of the coin stored one by one in each coin storing hole 8*a*, is inserted and fitted into the payout link 9. Each change slide 11 is formed to appear to and disappear from each coin storing hole 8*a*. The change slide 11 is moved by interlocking with the payout link 9, and when the change slide 11 is prevented from moving, the change slide 11 does not interlock with the payout link 9.

Each change lever 12 which is moved in a vertical direction by a driving means is disposed at a rear part of each change slide 11. The change lever 12 is mounted to a tip of a plunger of a change lever solenoid 13, and the driving means for the change lever 12 is formed by the change lever solenoid 13. The plunger of the change lever solenoid 13 is biased by a return spring in a protruding direction. The plunger is moved in a direction opposite to the protruding direction when the change lever solenoid 13 is energized, and the plunger is returned to the original position by a biasing force of the return spring when the energizing of the change lever solenoid 13 is stopped. Thus, the change lever 12 mounted to the tip of the plunger of the change lever solenoid 13 is located at a lower dispensing preventing position by the biasing force of the return spring when the energizing of the change lever solenoid 13 is stopped, and the change lever 12 prevents the change slide 11 from moving by engaging with a rear end of the change slide 11. The change lever 12 is moved upward and located at a dispensing allowing position when the change lever solenoid 13 is energized, and as a result, the engagement of the change lever 12 and the rear end of the change slide 11 is canceled and the change lever 12 becomes not to prevent a movement of the change slide 11. A plurality of mechanisms, each of which is provided with the change slide 11, the change lever 12 and the change lever solenoid 13 to correspond to each coin storing hole 8*a* one by one, is provided. The respective mechanisms are driven independently from each other.

In a state in which the change slide 11 is engaged with the corresponding change lever 12, as shown in FIG. 9(*b*), the change slide 11 is kept to locate at a position of the standby state without interlocking with the reciprocating movement of the payout link 9 and the payout slide 8, and a lower end of the corresponding coin storing hole 8*a* is closed by the change slide 11 in the dispensing state. Further, in a state in which the change slide 11 is disengaged from the corresponding change lever 12, as shown in FIG. 9(*a*), the change slide 11 is reciprocated by interlocking with the reciprocating movement of the payout link 9 and the payout slide 8, and the lower end of the corresponding coin storing hole 8*a* is opened by the change slide 11 in the dispensing state.

Here, as an example, a configuration in which the coin dispensing device dispenses the coin from only one coin tube 6 corresponding to a certain coin storing hole 8*a* is described.

Firstly, the change lever 12 is moved upward (switching operation) by energizing the change lever solenoid 13 corresponding to the coin storing hole 8*a* of the coin to be dispensed. With this, the engagement of the change lever 12 and the change slide 11 is canceled and the change slide 11 corresponding to the coin storing hole 8*a* of the coin to be dispensed becomes to be capable of reciprocating by interlocking with the reciprocating movement of the payout slide 8. On the other hand, since the change lever solenoid 13 corresponding to the coin storing hole of the coin not to be dispensed is not energized, the engagement of the change lever 12 and the change slide 11 is not canceled and the change slide 11 corresponding to the coin storing hole 8*a* of the coin not to be dispensed is prevented from moving.

Next, the payout cam 10 is driven by the driving means such as the motor not shown in Figs and turned once along the direction of the arrow A, and the payout link 9 and the payout slide 8 are reciprocated along the direction of the arrow B. Then, the coin stored in the coin storing hole 8*a* of the payout slide 8 is slid together with the payout slide 8 and the coin is moved (withdrawing operation) away from the bottom plate 7 which supports the coin stored in the coin storing hole 8*a* in the standby state. At this time, since the change slide 11 corresponding to the coin storing hole 8*a* of the coin to be dispensed has been slid rearward by interlocking with the movement of the payout link 9 and the payout slide 8, the lower end of the coin storing hole 8*a* is opened and the coin stored in the coin storing hole 8*a* is dropped and dispensed (discharging operation). On the other hand, since the change slide 11 corresponding to the coin storing hole 8*a* of the coin not to be dispensed is prevented from moving by the change lever 12, even if the payout link 9 and the payout slide 8 are moved, the change slide 11 is kept to locate at a position of the standby state. Thus, when the payout link 9 and the payout slide 8 are moved, a tip of the change slide 11 is appeared at the lower end of the coin storing hole 8*a*, and as a result the coin stored in the coin storing hole 8*a* is supported and therefore the coin is not dispensed.

Further, as shown in FIG. 8(*b*), in the coin dispensing device 3, in order to facilitate withdrawing of the coins when the coins stored in the coin dispensing device 3 are collected as sales, the coin storing part including the coin tube 6 is normally formed as a cassette 5 detachable from the coin dispensing device body 4. The detachable cassette 5 normally includes the coin tube 6, the bottom plate 7 and the payout slide 8. Further, when the cassette 5 is detached from the coin dispensing device body 4, the engagement of the payout slide 8 and the payout link 9 via the pin 9*b* is canceled. On the other hand, when the cassette 5 is attached to the coin dispensing device body 4, the payout slide 8 included in the cassette 5 and the payout link 9 included in the coin dispensing device body 4 are engaged with each other via the pin 9*b*.

In the conventional coin dispensing device described above, in principle, it is possible to dispense the coins from all of the coin tubes 6 simultaneously in one dispensing operation. But practically, since current provided to the coin processing device from the vending machine is limited, if the driving means for the payout cam 10 and the payout slide 8 is driven for the dispensing operation while energizing more than four change lever solenoid 13, current provided from the vending machine exceeds the limit of current. For example, in a case in which the limit of current provided from the vending machine is set to 1500 mA, a consumption current of the change lever solenoid 13 during driving is set to 150 mA, and a consumption current of the motor for driving the payout cam 10 and the payout slide 8 in the dispensing operation during driving is set to 1000 mA, if it is tried to dispense the coins from four coin tubes in one dispensing operation, total consumption current in the dispensing operation is represented by 150 mA×4+1000 mA=1600 mA, and exceeds 1500 mA of the limit of current provided from the vending machine. Thus, in the conventional coin dispensing device, it is normally set to dispense the coins from up to three coin tubes 6 in one dispensing operation (see Patent Literature 3).

CITATION LIST

Patent Literature

Patent Literature 1: JP H07-262426 A
Patent Literature 2: JP H11-161825 A
Patent Literature 3: JP 3054908 B

SUMMARY OF INVENTION

Technical Problem

In the coin dispensing device, it is generally demanded that a dispensing process of change should be performed as quick as possible. Further, in order to perform the dispensing process of change in a short time, it is considered to adopt a method of speeding up the dispensing operation or a method of increasing the coins to be dispensed in one dispensing operation. However, in the method of speeding up the dispensing operation, a coin jam is easily occurred and therefore remarkable speeding up is difficult. Further, in the method of increasing the coins to be dispensed in one dispensing operation, as described above, since a number of the coin tubes to be used in one dispensing operation is limited due to the limit of current provided from the vending machine, a number of the coins to be dispensed in one dispensing operation is also limited.

An object of the present invention is to solve the problem described above. Specifically, the object of the present invention is to provide a coin dispensing device capable of dispensing coins from many coin tubes in one dispensing operation or to provide a coin dispensing device capable of suppressing the maximum consumption current when coins are dispensed from a plurality of coin tubes in one dispensing operation.

Solution to Problem

In order to solve the above problem, the coin processing device according to claim 1 includes: a plurality of coin tubes, each of which stores coins; a bottom plate arranged below a plurality of the coin tubes; a coin withdrawing and discharging part configured to perform a withdrawing operation to withdraw the coin from a plurality of the coin tubes and a discharging operation to discharge the withdrawn coin from a position away from the bottom plate; change parts, each of which is provided to correspond to each coin tube, wherein each change part performs a switching operation to switch a change lever to a dispensing allowing position from a dispensing preventing position against a biasing force of a return spring by energizing a change lever solenoid and thereafter performs a return operation to return the change lever to the dispensing preventing position from the dispensing allowing position by the biasing force of the return spring with energizing of the change lever solenoid being stopped, and when the change lever is located at the dispensing preventing position, the change lever prevents the coin withdrawing and discharging part from performing the discharging operation, while when the change lever is located at the dispensing allowing position, the change lever allows the coin withdrawing and discharging part to perform the discharging operation; and a keeping means configured to keep a state of the change lever, wherein the keeping means can be selectively switched between a standby mode in which the keeping means allows the change lever of the change part to perform the switching operation and the return operation and a return preventing mode in which the keeping means prevents the change lever of the change part from performing the return operation, wherein the coin withdrawing and discharging part is configured to perform the withdrawing operation and the discharging operation when the keeping means is switched to the return preventing mode and the energizing of the change lever solenoid is stopped.

The coin processing device according to claim 2 is the coin dispensing device according to claim 1, wherein the keeping means includes a plurality of keeping projections and a keeping lever, the keeping projection formed integrally with the change lever, and the keeping lever including a main body and a plurality of prevention members formed on the main body, the prevention member includes a support part protruded upward from the main body, and a prevention part formed by a tip part of the support part bent along a moving direction of the keeping lever, and an escape space, into which the keeping projection formed on the change lever located at the dispensing preventing position can be inserted and received, is formed to be surrounded by the support part, the prevention part and the main body, the keeping lever is provided to be switchable between a standby position and a return preventing position, and when the keeping lever is located at the standby position, the standby mode is selected, while when the keeping lever is located at the return preventing position, the return preventing mode is selected, and by switching the keeping lever to the return preventing position from the standby position, the keeping projection of the change lever located at the dispensing preventing position is inserted and received into the escape space so that a movement of the keeping lever is allowed, the keeping projection of the change lever located at the dispensing allowing position is located outside the prevention part so that the keeping projection and the prevention part are arranged to face each other along a moving direction of the change lever, and thereafter even if the change lever tries to perform the return operation in which the change lever located at the dispensing allowing position is switched to the dispensing preventing position due to stopping of the energizing of the change lever solenoid, the keeping projection is received by the prevention part and the change lever is prevented from performing the return operation.

The coin processing device according to claim 3 is the coin dispensing device according to claim 2, further including a keeping lever solenoid configured to switch a position of the keeping lever between the standby position and the return preventing position from one to another, wherein the keeping lever is formed such that the keeping lever is located at the standby position when the energizing of the keeping lever solenoid is stopped, the keeping lever is switched to the return preventing position against the biasing force of the return spring by energizing the keeping lever solenoid, and thereafter the keeping lever is returned to the standby position by the biasing force of the return spring by stopping the energizing of the keeping lever solenoid, and when the energizing of the keeping lever solenoid is stopped in order to return the keeping lever from the return preventing position to the standby position, the change lever solenoid which drives the change lever located at the dispensing allowing position is momentarily energized at the same time or right after when the energizing of the keeping lever solenoid is stopped.

Advantageous Effects of Invention

According to the present invention, it is possible to suppress the maximum consumption current when coins are dispensed from many coin tubes in one dispensing operation.

BRIEF DESCRIPTION OF DRAWINGS

FIG. 1 is a back side perspective view of a main part of a coin dispensing device according to an embodiment of the present invention.

FIG. 2 is a front side perspective view of the main part of the coin dispensing device according to the embodiment of the present invention.

FIGS. 3(*a*) and 3(*b*) are perspective views of a keeping lever solenoid, a keeping lever; a link member, and an auxiliary member.

FIG. 4 is a back side view of the main part of the coin dispensing device according to the embodiment of the present invention in a state in which the keeping lever does not keep the change lever.

FIG. 5 is a back side view of the main part of the coin dispensing device according to the embodiment of the present invention in a state in which the keeping lever keeps the change lever.

FIGS. 6(*a*) to 6(*d*) are schematic diagrams illustrating operation of the coin dispensing device according to the embodiment of the present invention.

FIG. 7 is a schematic diagram illustrating a conventional coin processing device.

FIGS. 8(*a*) and 8(*b*) are cross-sectional views of a main part of the conventional coin dispensing device, in which FIG. 8(*a*) illustrates a standby state and FIG. 8(*b*) illustrates a cassette detaching state.

FIGS. 9(*a*) and 9(*b*) are cross-sectional views of the main part of the conventional coin dispensing device in a dispensing state.

FIG. 10 is a schematic perspective view of the conventional coin dispensing device.

DESCRIPTION OF EMBODIMENTS

Hereinafter, one of embodiments of the present invention is described with reference to drawings.

Firstly, one configuration according to the embodiment of the present invention is described with reference to FIGS. 1 and 2. FIG. 1 is a back side perspective view of a main part of a coin dispensing device according to the embodiment of the present invention, and FIG. 2 is a front side perspective view of the main part of the coin dispensing device according to the embodiment of the present invention. The configuration of the coin dispensing device of this embodiment is similar to that of the conventional coin dispensing device described above, except a part described below. Accordingly, components of this embodiment similar to those of the conventional coin dispensing device are denoted by the same reference numerals and the detailed explanation thereof is therefore omitted.

In addition to the configuration of the conventional coin dispensing device, the coin dispensing device according to this embodiment has a keeping means including a keeping lever 15, a keeping lever solenoid 14, a link member 16, and keeping projections 12*a*, each of which is integrally formed with each change lever 12. The keeping lever 15 is provided for keeping a state of the change lever 12 in the coin dispensing operation. The keeping lever solenoid 14 is provided for driving the keeping lever 15. The link member 16 is provided for transmitting a driving force of the keeping lever solenoid 14 to the keeping lever 15. The keeping projection 12*a* is used when the keeping lever 15 keeps a state of the change lever 12.

Each keeping projection 12*a* is formed on a part proximal to a back side lower part of each change lever 12 and integrally formed with each change lever 12.

The keeping lever 15 is formed in an elongate shape astride back side parts of all of the change levers 12 and mounted to a device body in a movable manner in a lateral direction. The keeping lever 15 is provided with an elongate body and a plurality of prevention members 15*a* protruding upward from the body. The prevention member 15*a* is formed at a position corresponding to the keeping projection 12*a* of the change lever 12 and provided with a support part protruding from the body and a prevention part bent along in a moving direction of the keeping lever 15 from a tip part of the support part. An escape space for the keeping projection 12*a* is formed and surrounded by the support part, the prevention part and the keeping lever body. Further, a hole 15*b* (see FIG. 3) which allows the keeping lever 15 to engage with the link member 16 is formed on the keeping lever 15 to be proximal to a position corresponding to the keeping lever solenoid. The hole 15*b* is formed such that its vertical length is longer than its lateral length.

The keeping lever solenoid 14 is mounted between the change lever solenoids 13 arranged in line such that a plunger is moved in a vertical direction. The keeping lever solenoid 14 is similar to the change lever solenoid 13. Namely, the plunger of the keeping lever solenoid 14 is biased in a protruding direction by a return spring. When the keeping lever solenoid 14 is energized, the plunger is moved in a direction opposite to the protruding direction, and when the energizing of the change lever solenoid 13 is stopped, the plunger is returned to the original position by a biasing force of the return spring. An auxiliary member 17 is mounted to the plunger of the keeping lever solenoid 14, and a groove 17*a* which allows the auxiliary member 17 to engage with the link member 16 is formed on the auxiliary member 17 (see FIG. 3). The groove 17*a* is formed such that its lateral length is longer than its vertical length.

FIGS. 3(*a*) and 3(*b*) illustrate the keeping lever solenoid 14, the keeping lever 15, the link member 16 and the auxiliary member 17, in which FIG. 3(*a*) is a back side perspective view and FIG. 3(*b*) is a front side perspective view. The link member 16 forms a part of a link means which changes a vertical movement of the plunger of the keeping lever solenoid 14 into a horizontal movement of the keeping lever 15. The link member 16 is formed in a substantially fan shape and mounted to the device body in a rotatable manner around a main part 16*a* of the fan shape as a pivot. A projection 16*b* to be engaged with the groove 17*a* formed on the auxiliary member 17 of the keeping lever solenoid 14 is formed on the fan-shaped link member 16 at a position proximal to one end of an arc part of the link member 16, and a projection 16*c* to be engaged with the hole 15*b* formed on the keeping lever 15 is formed on the fan-shaped link member 16 at a position proximal to another end of the arch part of the link member 16.

When the keeping lever solenoid 14 is energized, the plunger and the auxiliary member 17 of the keeping lever solenoid 14 are moved upward, and therefore an upward force is applied on the projection 16*b* of the link member 16 engaging with the groove 17*a* formed on the auxiliary member 17. Due to the upward force applied on the projection 16*b*, the link member 16 is rotated around the main part 16*a* as a pivot in a clockwise direction when seen from the back side, and the projection engaging with the hole 15*b* formed on the keeping lever 15 is moved leftward. When the projection is moved leftward, a leftward force is applied on the keeping lever 15 via the hole 15*b* formed on the keeping lever 15, and therefore the keeping lever 15 is moved leftward.

When the energizing of the keeping lever solenoid 14 is stopped, the plunger and the auxiliary member 17 are returned to their original lower positions by the biasing force of the return spring, and a downward force is applied on the projection 16*b* of the link member 16 engaging with the groove 17*a* formed on the auxiliary member 17. Due to the downward force applied on the projection 16*b*, the link member 16 is rotated around the main part 16*a* as a pivot in a counterclockwise direction when seen from the back side, and the projection 16*c* engaging with the hole 15*b* formed on the keeping lever 15 is moved rightward. When the projection 16*c* is moved rightward, a rightward force is applied on the keeping lever 15 via the hole 15*b* formed on the keeping lever 15, and therefore the keeping lever 15 is moved rightward and returned to its original position. Since the plunger of the keeping lever solenoid 14 is biased by the return spring, the keeping lever 15 is also biased rightward.

In this way, when the keeping lever solenoid 14 is energized, the keeping lever 15 is moved and stayed at a left position (return preventing position), and when the energizing of the keeping lever solenoid 14 is stopped, the keeping lever 15 is returned to the original position (standby position).

Next, operation of the coin dispensing device according to the embodiment of the present invention when the coin is dispensed is described with reference to FIGS. 4, 5 and 6(*a*) to 6(*d*). FIG. 4 is a back side view of the main part of the coin dispensing device according to the embodiment of the present invention in a state in which the keeping lever 15 does not keep the change lever 12, FIG. 5 is a back side view of the main part of the coin dispensing device according to the embodiment of the present invention in a state in which the keeping lever 15 keeps the change lever 12, and FIGS. 6(*a*) to 6(*d*) are schematic diagrams illustrating operation of the coin dispensing device according to the embodiment of the present invention. In FIGS. 6(*a*) to 6(*d*), only the keeping lever 15 and the keeping projection 12*a* are illustrated. FIG. 4 corresponds to FIG. 6(*a*), and FIG. 5 corresponds to FIG. 6(*d*).

In the standby state in which the energizing of the change lever solenoid 13 and the keeping lever solenoid 14 is stopped, as shown in FIG. 6(*a*), the keeping lever 15 is located at the standby position, and the change lever is located at the dispensing preventing position. In a state in which the keeping lever 15 is located at the standby position, the prevention member 15*a* of the keeping lever 15 is located at a position away from a movable area of the keeping projection 12*a* of the change lever 12. Thus, the change lever 12 can be moved without being prevented from moving by the keeping lever 15.

When the coin is dispensed, the change lever solenoid 13 corresponding to the coin tube 6 of the coins to be dispensed is energized in the standby state. When the change lever solenoid 13 is energized, as shown in FIG. 6(*b*), the change lever 12 corresponding to the energized change lever solenoid 13 is moved upward (switching operation) and located at the dispensing allowing position. At this time, the keeping projection 12*a* formed integrally with the change lever 12 is also moved upward. Since the change lever solenoid for the change lever 12 corresponding to the coin tube of the coins not to be dispensed is not energized, the change lever 12 is stayed at the dispensing preventing position. In an example shown in FIG. 6(*b*), four change levers 12 except the right end change lever are moved upward and located at the dispensing allowing position, and the right end change lever 12 is stayed at the dispensing preventing position.

Thereafter, the keeping lever solenoid 14 is energized, and as shown in FIG. 6(*c*), the keeping lever is moved leftward and located at the return preventing position. When the keeping lever 15 is located at the return preventing position, as to the change lever 12 located at the dispensing allowing position, the prevention part of the prevention member 15*a* is moved below the keeping projection 12*a*, and therefore the keeping lever 15 prevents the change lever 12 from moving downward (return operation). In such a state in which the keeping lever 15 prevents the change lever 12 from moving downward (return operation), the prevention part of the prevention member 15*a* of the keeping lever 15 is located to prevent the keeping projection 12*a* of change lever 12 from moving. Namely, as to the change lever 12 moved upward and located at the dispensing allowing position, an upper surface of the prevention part of the prevention member 15*a* is located to face a bottom surface of the keeping projection 12*a* of the change lever 12, and therefore a downward movement (return operation) of the change lever 12 is prevented. On the other hand, as to the change lever 12 stayed at the dispensing preventing position without moving upward, when the keeping lever 15 is located at the return preventing position, the keeping projection 12*a* of the change lever 12 is received and inserted into the escape space surrounded by the body and the prevention member 15*a* of the keeping lever 15. In this way, since the keeping projection 12*a* of the change lever 12 located at the dispensing preventing position is received into the escape space, the keeping lever 15 can be moved to the return preventing position without being disturbed by the change lever 12 located at the dispensing preventing position.

After being switched to the state in which the downward movement of the change lever 12 (return operation) is prevented by the keeping lever 15, the energizing of the change lever solenoid 13 is stopped. When the energizing of the change lever solenoid 13 is stopped, as shown in FIG. 6(*d*), although the change lever 12 moved upward and located at the dispensing allowing position is tried to return to the dispensing preventing position by the biasing force of the return spring, since the bottom surface of the keeping projection 12*a* is received by the upper surface of the prevention part of the prevention member 15*a* of the keeping lever 15, the change lever 12 is kept to locate at the dispensing allowing position.

Thereafter, the motor provided as the driving means for the payout cam 10 and the payout slide 8 is driven and the coin is dispensed. When the motor provided as the driving means for the payout cam 10 and the payout slide 8 is driven, the energizing of all change lever solenoids 13 is stopped, and only the keeping lever solenoid 14 is simultaneously driven together with the motor provided as the driving means for the payout cam 10 and the payout slide 8. Further, after the coin is dispensed, the energizing of the keeping lever solenoid 14 is stopped, and the keeping lever 15 is moved leftward by the biasing force of the return spring and returned to the standby position. Thus, the prevention of the downward movement (return operation) of the change lever 12 by the keeping lever 15 is canceled, and the change lever 12 located at the dispensing allowing position is returned to the dispensing preventing position.

In this embodiment, since the keeping lever 15 is biased toward the standby position by the return spring of the keeping lever solenoid 14, even if the keeping lever solenoid 14 is failed, an inadvertent dispensing of the coin caused by keeping the change lever 12 in a wrong position can be prevented.

Further, in this embodiment, since the plunger of the change lever solenoid 13 is biased in the protruding direction by the return spring, when the change lever 12 located at the dispensing allowing position is kept by the keeping lever 15, the upper surface of the prevention member 15*a* of the keeping lever 15 is pushed by the bottom surface of the keeping projection 12*a* of the change lever 12. Thus, when the energizing of the keeping lever solenoid 14 is stopped, return of the keeping lever 15 to the standby position might be prevented. In response to this, when the energizing of the keeping lever solenoid 14 is stopped in order to return the keeping lever 15 to the standby position from the return preventing position, the change lever 12 can be controlled to be moved upward by momentarily energizing the change lever solenoid 13 which drives the change lever 12 located at the dispensing allowing position at the same time or right after when the energizing of the keeping lever solenoid 14 is stopped. The time period of the momentarily energizing is preferably set to an enough time period to be able to return the keeping lever 15 located at the return preventing position to the standby position.

Further, in the general coin processing device, since a memory is reset when the coin processing device is turned off, a processing state (whether it is in a standby state or in a dispensing state) is uncertain when the coin processing device is turned on again. Thus, in the general coin processing device, an initial operation is performed to be set to the standby state when the coin processing device is turned on. In the initial operation, the coin dispensing device is returned to the standby state by performing the dispensing operation without driving the change lever solenoid 13. However, in the coin dispensing device according to this embodiment, since information of the change lever 12 located at the dispensing allowing position is deleted when the coin dispensing device is turned off, it is unable to move upward only the change lever 12 located at the dispensing allowing position. Accordingly, all of the change levers 12 are moved upward, however if the change lever 12 located at the dispensing preventing position is moved upward, the keeping lever 15 might be prevented from returning to the standby position because the upper surface of the keeping projection 12*a* is contacted with the bottom surface of the prevention part of the prevention member 15*a* of the keeping lever 15. To this problem, it can be solved to form an inclined surface on the bottom surface of the prevention part of the prevention member 15*a* of the keeping lever 15 so that a force in a moving direction of the keeping lever 15 toward the standby position is occurred when the keeping projection 12*a* is moved upward and contacted with the bottom surface of the prevention part. In addition, it can be also solved to repeat a control of the change lever 12 to move momentarily upward the change lever 12 in a short time in order to facilitate the return of the keeping lever 15 by the impulse or vibration.

According to the coin dispensing device according to the embodiment described above, the maximum consumption current can be suppressed when the coins are dispensed from many coin tubes in one dispensing operation. For example, in a case in which the limit of current provided from the vending machine is set to 1500 mA, a consumption current of the change lever solenoid 13 during driving is set to 150 mA, a consumption current of the keeping lever solenoid 14 during driving is set to 200 mA and a consumption current of the motor for driving the payout cam 10 and the payout slide 8 in the dispensing operation during driving is set to 1000 mA, even if the coins are dispensed from five coin tubes in one dispensing operation, the maximum consumption current during the dispensing operation, which is represented by 200 mA+1000 mA=1200 mA, can be suppressed. Further, since the maximum consumption current in one dispensing operation in which the coins are dispensed from many coin tubes can be suppressed, it becomes possible to dispense the coins from many coin tubes in one dispensing operation. Further, since the change lever solenoid is not energized during the dispensing operation, the consumption current can be suppressed.

One embodiment of the present invention is described above, however the coin dispensing device of the present invention is not limited to this embodiment.

The keeping means in the coin dispensing device of the present invention may be formed to keep a state of the change lever during the coin dispensing operation, and therefore it is not limited to a configuration in the embodiment described above.

In the embodiment described above, the keeping lever solenoid 14 is mounted between the change lever solenoids 13 arranged in line, however the keeping lever solenoid 14 may be arranged in a lateral direction so that the keeping lever solenoid 14 directly drives the keeping lever 15 without using the link member 16. However, as described in the above embodiment, by adopting a configuration in which the keeping lever solenoid 14 is mounted between the change lever solenoids 13 arranged in line and the keeping lever 15 is driven via the link member 16, space can be used effectively.

REFERENCE SIGNS LIST

1 coin processing device
2 coin sorting device
3 coin storing device
4 coin dispensing device
5 cassette
6 coin tube
7 cassette bottom plate
8 payout slide
9 payout link
10 payout cam
11 change slide
12 change lever
12*a* keeping projection
13 change lever solenoid
14 keeping lever solenoid
15 keeping lever
15*a* prevention member
16 link member
16*a* main part
17 auxiliary member
C coin

The invention claimed is:

1. A coin dispensing device, comprising:

a plurality of coin tubes, each of which stores coins;

a bottom plate arranged below a plurality of the coin tubes;

a coin withdrawing and discharging part configured to perform a withdrawing operation to withdraw the coin from a plurality of the coin tubes and a discharging operation to discharge the withdrawn coin from a position away from the bottom plate;

change parts, each of which is provided to correspond to each coin tube, wherein each change part performs a switching operation to switch a change lever to a dispensing allowing position from a dispensing preventing position against a biasing force of a return spring by energizing a change lever solenoid and thereafter performs a return operation to return the change lever to the dispensing preventing position from the dispensing allowing position by the biasing force of the return spring with energizing of the change lever solenoid being stopped, and when the change lever is located at the dispensing preventing position, the change lever prevents the coin withdrawing and discharging part from performing the discharging operation, while when the change lever is located at the dispensing allowing position, the change lever allows the coin withdrawing and discharging part to perform the discharging operation; and a keeping means configured to keep a state of the change lever of each of the change parts, wherein the keeping means can be selectively switched between a standby mode in which the keeping means allows the change lever of the change part to perform the switching operation and the return operation and a return preventing mode in which the keeping means prevents the change lever of the change part from performing the return operation, wherein the coin withdrawing and discharging part is configured to perform the withdrawing operation and the discharging operation when the keeping means is switched to the return preventing mode and the energizing of the change lever solenoid is stopped.

2. The coin dispensing device according to claim 1, wherein the keeping means includes a plurality of keeping projections and a keeping lever, the keeping projection formed integrally with the change lever, and the keeping lever including a main body and a plurality of prevention members formed on the main body, the prevention member includes a support part protruded upward from the main body, and a prevention part formed by a tip part of the support part bent along a moving direction of the keeping lever, and an escape space, into which the keeping projection formed on the change lever located at the dispensing preventing position can be inserted and received, is formed to be surrounded by the support part, the prevention part and the main body, the keeping lever is provided to be switchable between a standby position and a return preventing position, and when the keeping lever is located at the standby position, the standby mode is selected, while when the keeping lever is located at the return preventing position, the return preventing mode is selected, and by switching the keeping lever to the return preventing position from the standby position, the keeping projection of the change lever located at the dispensing preventing position is inserted and received into the escape space so that a movement of the keeping lever is allowed, the keeping projection of the change lever located at the dispensing allowing position is located outside the prevention part so that the keeping projection and the prevention part are arranged to face each other along a moving direction of the change lever, and thereafter even if the change lever tries to perform the return operation in which the change lever located at the dispensing allowing position is switched to the dispensing preventing position due to stopping of the energizing of the change lever solenoid, the keeping projection is received by the prevention part and the change lever is prevented from performing the return operation.

3. The coin dispensing device according to claim 2, further comprising a keeping lever solenoid configured to switch a position of the keeping lever between the standby position and the return preventing position, wherein the keeping lever is formed such that the keeping lever is located at the standby position when the energizing of the keeping lever solenoid is stopped, the keeping lever is switched to the return preventing position against the biasing force of the return spring by energizing the keeping lever solenoid, and thereafter the keeping lever is returned to the standby position by the biasing force of the return spring by stopping the energizing of the keeping lever solenoid, and when the energizing of the keeping lever solenoid is stopped in order to return the keeping lever from the return preventing position to the standby position, the change lever solenoid which drives the change lever located at the dispensing allowing position is momentarily energized at the same time or right after when the energizing of the keeping lever solenoid is stopped.

* * * * *